US005401552A

United States Patent [19]

Bohrer et al.

[11] Patent Number: 5,401,552

[45] Date of Patent: Mar. 28, 1995

[54] GEOCOMPOSITE LINER

[75] Inventors: John L. Bohrer, Houston, Tex.; Harald Unger, Hamburg, Germany

[73] Assignee: SLT Environmental, Inc., Conroe, Tex.

[21] Appl. No.: 187,835

[22] Filed: Jan. 28, 1994

[51] Int. Cl.[6] ..... B32B 3/02

[52] U.S. Cl. ..... 428/87; 156/148; 156/308.2; 405/15; 405/270; 428/85; 428/110; 428/234; 428/241; 428/246; 428/283; 428/296; 428/300; 428/247

[58] Field of Search ..... 156/148, 308.2; 428/85, 428/87, 110, 246, 247, 296, 234, 238, 239, 325, 300, 283, 137, 138, 269; 405/15, 270

[56] References Cited

U.S. PATENT DOCUMENTS

| | | | |
|---|---|---|---|
| 3,615,989 | 10/1971 | Depoe | 428/300 |
| 3,616,168 | 10/1971 | Johnstone | 428/300 |
| 4,205,113 | 5/1980 | Hermansson et al. | 428/300 |
| 4,477,938 | 10/1984 | Rogut | 428/300 |
| 5,041,330 | 8/1991 | Heerten et al. | 428/300 |
| 5,080,951 | 1/1992 | Guthrie | 428/300 |
| 5,174,231 | 12/1992 | White | 428/300 |
| 5,216,790 | 6/1993 | Eschenbach | 428/296 |
| 5,221,568 | 6/1993 | Heerten et al. | 428/300 |
| 5,237,945 | 8/1993 | White | 156/148 |
| 5,322,581 | 6/1994 | Heerten et al. | 428/300 |

FOREIGN PATENT DOCUMENTS 2202185 9/1988 United Kingdom .

OTHER PUBLICATIONS

Advertisement of Nicolon Corporation, "Geosynthetic Solutions", (date unknown).

SLT North American, Geosynthetic Specification Guide, Bentoliner TM Geocomposite Clay Liner, 1992.

*Primary Examiner*—James J. Bell

*Attorney, Agent, or Firm*—Harrison & Egbert

[57] ABSTRACT

A geocomposite liner having a first fibrous layer, a second fibrous layer, and a non-fibrous layer secured between the first and second fibrous layers. A plurality of fibers extend from the non-fibrous layer such that the ends of the fibers extend outwardly of an outer surface of the first fibrous layer. The ends are heat fused so as to secure the ends outwardly of the outer surface of the first fibrous layer. The second fibrous layer is needle punched such that the fibers extend from the second fibrous layer through the non-fibrous layer. The ends of the fibers are heat fused such that the ends have a greater diameter exterior of the first fibrous layer than interior of the first fibrous layer. Some of the ends are heat fused together on the outer surface of the first fibrous layer.

20 Claims, 1 Drawing Sheet

GEOCOMPOSITE LINER

TECHNICAL FIELD

The present invention relates to multiple layer liner material, in general. More particularly, the present invention relates to geocomposite liners used for environmental lining.

BACKGROUND ART

Geocomposite liners are well known for the purpose of containment of materials. In particular, geocomposite clay liners (GCL's) offer engineers the designability to achieve permeability properties equal to the placement of two-to-three feet of clay in containment applications with approximately one-quarter inch of material. The use of such geocomposite clay liners serves to significantly increase storage space. In conventional applications, these geocomposite clay liners are placed over a subgrade in the containment area. After these geocomposite liners are placed over the subgrade, a fill material may be placed over the outer surface of the geocomposite liner.

Conventional geocomposite clay liners use contaminant resistant sodium bentonites which are encapsulated between two layers of a polypropylene geotextile. The upper geotextile is a non-woven needle punched fabric designed to assure maximum strength and confinement of the clay in a hydrated state, while allowing sufficient liquid penetration to assure intimate contact when used in conjunction with a geomembrane. The geotextile used on the bottom side of the liner is a woven, slit-film material manufactured to optimize both the internal shear strength of the finished product and its friction angle with the soils below.

In normal use, the conventional geocomposite clay liner will include a first fibrous layer, a second fibrous layer, and a sodium bentonite material therebetween. The needle punched top layer will have fibers extending upwardly and into the upper woven material. These fibers will extend outwardly of the woven bottom layer. The use of this needle punching serves to create a mechanical non-adhesive containment of the bentonite between the layers.

Unfortunately, when such a geocomposite clay liner is placed on the subgrade, the shear forces applied to the GCL will cause the upper fibrous layer to separate from the lower fibrous layer. There are three fundamental reasons for the separation of the upper and lower layers. First, the high shear forces that can be applied to the liner during installation and use can force the separation of the layers. Secondly, the sodium bentonite, when wet, acts as a lubricant between the layers. This lubricant-type action facilitates the movement of one layer with respect to the other layer. Thirdly, the use of the needle punching does not provide any true resistance to the separation of the layers. The needle punching is carried out for the purpose of the containment of the bentonite between the layers. The ends of the needle punched fibers extend freely outwardly of the lower woven layer. As such, when slippage occurs between the layers, the ends of the fibers offer no resistance to this separation.

It is an object of the present invention to provide a geocomposite liner that effectively resists slippage between the layers.

It is another object of the present invention to provide a geocomposite liner that withstands shear forces placed upon the liner material in actual installation and use.

It is a further object of the present invention to provide a geocomposite liner that effectively contains the sodium bentonite (or related material) between the outer layers.

It is still another object of the present invention to provide a geocomposite liner that is easy to manufacture, easy to use, and easy to install.

These and other objects and advantages of the present invention will become apparent from a reading of the attached specification and appended claims.

SUMMARY OF THE INVENTION

The present invention is a geocomposite liner that includes a first fibrous layer, a second fibrous layer, and a non-fibrous layer secured between the first and second fibrous layers. A plurality of fibers extend from the non-fibrous layer such that the ends of the fibers extend outwardly of an outer surface of the first fibrous layer. The ends are heat fused so as to secure the ends outwardly of the outer surface of the first fibrous layer. In the preferred embodiment of the present invention, the second fibrous layer is needle punched such that the fibers extend outwardly from the second fibrous layer through the non-fibrous layer. The second fibrous layers is of a non-woven material. The first fibrous layer is a woven support layer. The ends can be heat fused together at the outer surface of the first fibrous layer. Specifically, each of the ends of the plurality of fibers are heat fused such that the ends have a Greater diameter exterior of the first fibrous layer than interior of this layer. The non-fibrous layer is mechanically and non-adhesively affixed between the first and second fibrous layers. The non-fibrous layer is made up of sodium bentonite particles which are retained between the first and second fibrous layers.

In an alternative embodiment of the present invention, the non-fibrous layer can be a geonet. The first fibrous layer is heat bonded to a surface of the geonet. The fibers extend from heat-bonded adherence to the geonet. The second fibrous layer is also heat bonded to an opposite surface of the geonet. The second fibrous layer also has a plurality of fibers which are bonded to the geonet and extend through the second fibrous layer such that the fibers have ends extending outwardly of the exterior surface of the second fibrous layer. These ends are then heat fused at the exterior surface.

The present invention is also a method of forming a geocomposite liner including the steps of: (1) placing a layer of sodium bentonite material between a first fibrous layer and a second fibrous layer; (2) needle punching the second fibrous layer such that the fibers extend through the sodium bentonite layer and have ends extending outwardly of the first fibrous layer; and (3) heat fusing the ends of the fibers exterior of the first fibrous layer. The step of heat fusing includes heating the ends of the fiber such that the ends have a greater diameter than those fibers extending through the sodium bentonite layer. Alternatively, the step of heat fusing can include heating the ends such that some of the ends of the fibrous layers fuse together on the exterior of the first fibrous layer. The heat fusing can be accomplished by positioning the ends of the fibers in proximity to a flame front having a temperature suitable for melting the ends to a desired degree. In place of the flame front, an electrical heating bar can be used or a sonic heat generating device can be used.

DETAILED DESCRIPTION OF THE INVENTION

Figure 1:
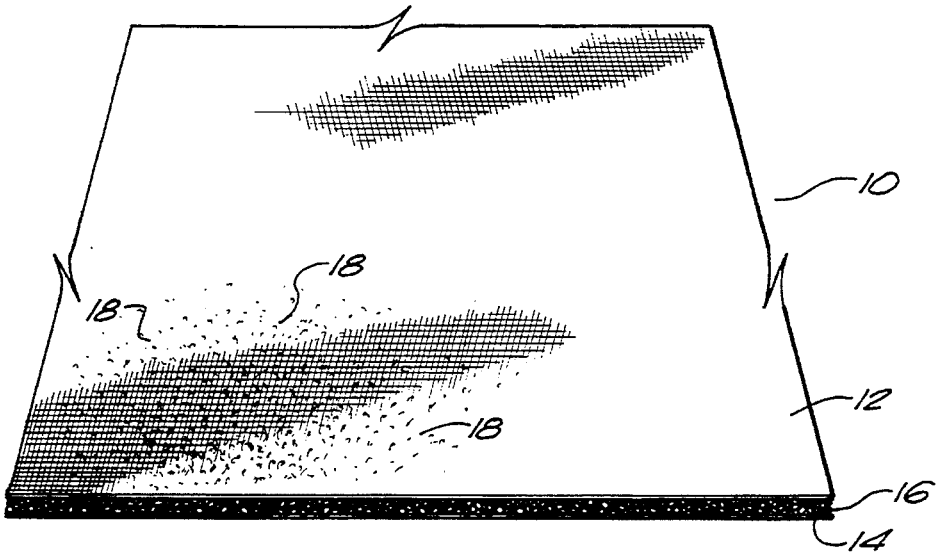
FIG. 1 is a bottom perspective view of the geocomposite clay liner in accordance with the preferred embodiment of the present invention.

Referring to FIG. 1, there is shown at 10 the geocomposite clay liner in accordance with the preferred embodiment of the present invention. The geocomposite clay liner 10, as illustrated in FIG. 1, is a portion of a section of an overall liner panel. The geocomposite clay liner 10 of the present invention includes a first fibrous layer 12, a second fibrous layer 14, and a non-fibrous layer 16. The non-fibrous layer 16 is secured between the first fibrous layer 12 and the second fibrous layer 14. A plurality of fibers extend through the non-fibrous layer 14 such that the ends of the fibers (designated at 18 in FIG. 1) extend outwardly of the outer surface of the first fibrous layer 12. The ends 18 are heat fused so as to secure these ends 18 outwardly of the first fibrous layer 12. For the purposes of illustration, the ends 18 are shown over only a portion of the surface of the first fibrous layer 12. In actual practice, the ends 18 would extend outwardly along the entire outer surface of the first fibrous layer 12.

The geocomposite clay liner 10 includes sodium bentonite as the non-fibrous layer 16. The contaminant resistant sodium bentonite 16 is essentially encapsulated between the first fibrous layer 12 and the second fibrous layer 14. The first fibrous layer 12 is a woven slit-film material designed to assure maximum strength and confinement of the bentonite 16 in a hydrated state. The second fibrous layer 14 is a geotextile which is utilized on an opposite side of the geocomposite clay liner 10. The second fibrous layer 14 is a non-woven, needle punched fabric. Various types of bentonite can be used in the non-fibrous layer 16. Additionally, as will be described in conjunction with the alternative embodiment of the present invention, various other materials can be used as the non-fibrous layer 16.

In general, the liner 10 is manufactured by the mechanical bonding of the needle punch process so as to enhance the friction characteristics of the liner 10 and to maintain the integrity of the liner under hydration. No glues or adhesives are used, in lieu of the needle punch process, so as to retain these characteristics. The needled bentonite geocomposites are those which, by the process of a needling board (similar to that used in the manufacture of standard non-woven geotextiles), have fibers of a non-woven geotextile pushed through the bentonite clay core (the non-fibrous layer 16) and integrated into the woven first fibrous layer 12, without the use of any chemical binders or adhesives.

Figure 2:
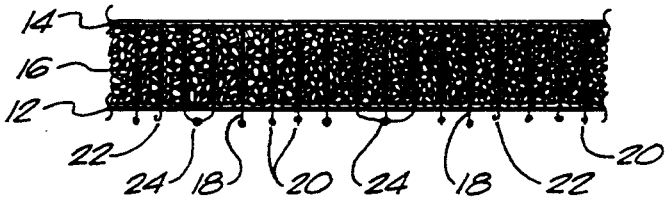
FIG. 2 is a magnified side cross-sectional view of the geocomposite clay liner of the preferred embodiment of the present invention.

As can be seen in FIG. 2, the non-fibrous layer 16 is sandwiched between the first fibrous layer 12 and the second fibrous layer 14. As can be seen, the needle punched fibers of the second fibrous layer 14 extend through the bentonite material of the non-fibrous layer 16. Ends 18 extend outwardly beyond the surface of the first fibrous layer 12.

In the present invention, the ends are suitably heat fused so as to be secured to the first fibrous layer 12. The ends 18 are properly heat fused by placing them in proximity to a source of heat. This source of heat can be a flame front, an electrical heating bar, or a sonic heating source. When the ends 18 of the fibers are heated to a melting point, the ends 18 will assume various configurations. With reference to FIG. 2, it can be seen that some of the ends 18 "ball up", as shown at 20, such that the ends have a greater diameter exterior of the first fibrous layer 12 than interior of the first fibrous layer. In other circumstances, the ends 18, as shown at 22 have a generally hook-like shape. The otherwise straight end of the fibers will "curl" in the presence of heat. This hook-like appearance will also serve to mechanically secure the fibers to the first fibrous layer 12. In other circumstances, several of the fibers will fuse together, as illustrated at 24. When several of the fibers have their ends fused together, these ends will lock together on the exterior of the first fibrous layer 12. In all of these circumstances, the fibers extending from the second fibrous layer 14 will be secured to the first fibrous layer 12. As a result, when shear forces are applied to the first fibrous layer 12 and the second fibrous layer 14, the heat fused characteristics of the ends 18 of the fibers will resist the separation of the first fibrous layer 12 from the second fibrous layer 14. As a result, the non-fibrous layer 16, including the bentonite, will be retained between these layers. As such, the integrity of the geocomposite clay liner can be maintained for a greater period of time. The effect of heating the ends 18 of the fibers serves to "lock" the fibers in place.

Figure 3:
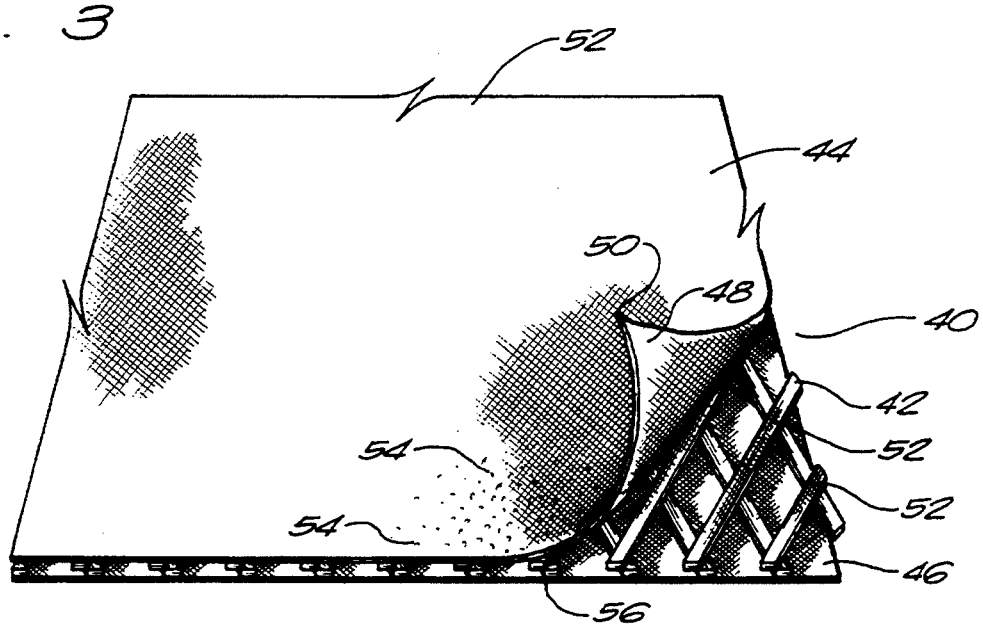
FIG. 3 is a perspective view of an alternative embodiment of the present invention showing one corner as pulled apart from the central geonet layer material.

FIG. 3 shows an alternative embodiment 40 of the present invention illustrating, in particular, a geocomposite liner having a geonet 42 formed therein. As can be seen, the geonet 42 is a cross-hatched arrangement of polymeric material positioned between a first fibrous layer 44 and a second fibrous layer 46. The cross-hatched non-fibrous polymeric geonet layer 42 is heat bonded to the underside 48 of the first fibrous layer 44. Similarly, the underside of the geonet 42 will be heat bonded a surface of the second fibrous layer 46. In normal use, geonets, and the associated fibrous layers 44 and 46, are used for drainage purposes in containment areas. Liquids will pass through the fibrous layers 44 and 46 and into the area defined by the geonet 42. The cross hatched arrangement of the geonet 42 will serve to direct the flow of the liquid in a desired manner.

One of the major problems affecting the geocomposite liner 40, as illustrated in FIG. 3, is the effect of shear forces applied to the fibrous layers 44 and 46. For example, the corner 50 of the first fibrous layer 44 is shown as pulled from the outer surface of the geonet 42. When the first fibrous layer 44 encounters shear forces, the first fibrous layer 44 will have a tendency to "pull apart" from the geonet 42. When the first fibrous layer 44 pulls apart from the geonet 42, fibers 52 will remain on portions of the geonet 42. When the corner 50 separates from the geonet 42, the integrity of the containment system is compromised. Additionally, the first fibrous layer 44 will continue to separate from the geonet 42 under the presence of shear forces affecting the geocomposite liner 40. Similarly, the shear forces will tend to separate the second fibrous layer 46 from the geonet 42, in the manner described hereinbefore.

In the present invention, the outer surface 52 of the first fibrous layer 44 is brought into proximity to a source of heat. As a result, the fiber ends 54 will become heat fused on the outer surface 52. This heat fusing will serve to further lock the first fibrous layer 44 to the geonet 42. This heat fusing of the ends 54 will resist the pulling away of the corner 50 from the geonet 42. The "heat fused" ends 44 of the fibers will take on an appearance similar to that shown in FIG. 2. The other ends of the fibers are heat bonded to the surfaces of the geonet 42. As such, these fibers will extend from the non-fibrous layer 42 through the fibrous layer 44 and outwardly therefrom. Similarly, the same arrangement is applied with respect to the second fibrous layer 46. The bottom side 56 of the second fibrous layer 46 will be placed in proximity to a source of heat so that the ends of the fibers (affixed to the geonet 42 and extending through the second fibrous layer 46) will become heat fused in the manner described hereinbefore. As a result, in the geocomposite liner 40, as illustrated in FIG. 3, the fibrous layers 44 and 46 will become more resistive of shear forces applied thereto.

In the embodiment shown in FIG. 3, the fibrous layers 44 and 46 can be made of identical non-woven geotextiles.

The foregoing disclosure and description of the invention is illustrative and explanatory thereof. Various changes in the details of the illustrated apparatus, or in the steps of the described method, can be made within the scope of the appended claims without departing from the true spirit of the invention. The present invention should only be limited by the following claims and their legal equivalents.

We claim:

1. A geocomposite liner comprising:
a first fibrous layer;
a second fibrous layer; and
a non-fibrous layer secured between said first and second fibrous layers, wherein a plurality of fibers extend from said non-fibrous layer such that ends of said fibers extend outwardly of an outer surface of said first fibrous layer, said ends being heat fused so as to secure said ends outwardly of said outer surface.

2. The geocomposite liner of claim 1, said second fibrous layer being needle punched such that fibers extend from said second fibrous layer through said non-fibrous layer.

3. The geocomposite liner of claim 2, said second fibrous layer being of a non-woven material, said first fibrous layer being a woven support layer.

4. The geocomposite liner of claim 1, at least some of said ends being heat fused together at said outer surface of said first fibrous layer.

5. The geocomposite liner of claim 1, each of said ends of said plurality of fibers being heat fused such that said ends have a greater diameter exterior of said first fibrous layer than interior of said first fibrous layer.

6. The geocomposite liner of claim 1, said non-fibrous layer being mechanically and non-adhesively affixed between said first and second fibrous layers.

7. The geocomposite liner of claim 6, said non-fibrous layer being sodium bentonite particles retained between said first and second fibrous layers.

8. The geocomposite liner of claim 1, said non-fibrous layer being a geonet, said first fibrous layer being heat bonded to a surface of said geonet, said fibers extending from heat bonded adherence to said geonet.

9. The geocomposite liner of claim 8, said second fibrous layer being heat bonded to an opposite surface of said geonet, said second fibrous layer having a plurality of fibers bonded to said geonet and extending through said second fibrous layer such that said fibers have ends extending outwardly of an exterior surface of said second fibrous layer, said ends being heat fused at said exterior surface.

10. A geocomposite liner comprising:
a first fibrous layer;
a second fibrous layer; and
a sodium bentonite layer retained between said first and second fibrous layers, said second fibrous layer being needle punched such that fibers of said second fibrous layer extend through said sodium bentonite layer, said fibers having ends extending outwardly of an exterior surface of said first fibrous layer, said ends being heat fused.

11. The geocomposite liner of claim 10, at least some of said ends of said plurality of fibers being heat fused together.

12. The geocomposite liner of claim 10, each of said ends of said plurality of fibers being heat fused such that said ends have a greater diameter exterior of said first fibrous layer than interior of said first fibrous layer.

13. The geocomposite liner of claim 10, said second fibrous layer being of a non-woven material, said first fibrous layer being of a woven support layer.

14. The geocomposite liner of claim 13, said woven support layer being a slit film layer.

15. A method of forming a geocomposite liner comprising the steps of:
placing a layer of sodium bentonite material between a first fibrous layer and a second fibrous layer;
needle punching said second fibrous layer such that fibers extend through said sodium bentonite layer and said fibers having ends extending outwardly of said first fibrous layer; and
heat fusing the ends of said fibers exterior of the first fibrous layer.

16. The method of claim 15, said step of heat fusing comprising the step of:
heating said ends of said fibers such that said ends have a greater diameter than said fibers extending through said sodium bentonite layer.

17. The method of claim 15, said step of heat fusing further comprising the step of:
heating said ends such that at least some of said ends of said fibers fuse together exterior of said first fibrous layer.

18. The method of claim 15, further comprising the step of:
positioning said ends of said fibers in proximity to a flame front having a temperature suitable for melting said ends to a desired degree.

19. The method of claim 15, further comprising the step of:
positioning said ends of said fibers in proximity to an electrical heating bar having a temperature suitable for melting said ends to a desired degree.

20. The method of claim 15, further comprising the step of:
positioning said ends of said fibers in proximity to a sonic heat generator suitable for producing a melting temperature in said ends of said fibers.

* * * * *